US007131300B1

(12) United States Patent
Monasco

(10) Patent No.: US 7,131,300 B1
(45) Date of Patent: Nov. 7, 2006

(54) SEAL GUARD

(76) Inventor: Larry Monasco, 3474 Bobolink Rd., Gilmer, TX (US) 75645

( * ) Notice: Subject to any disclaimer, the term of this patent is extended or adjusted under 35 U.S.C. 154(b) by 0 days.

(21) Appl. No.: 11/148,019

(22) Filed: Jun. 9, 2005

(51) Int. Cl.
*E05B 67/38* (2006.01)

(52) U.S. Cl. ..... 70/55; 70/56; 70/129; 70/417; 70/DIG. 43; 70/DIG. 56; 292/148; 292/205; 292/307 B; 292/DIG. 32

(58) Field of Classification Search ..... 70/2, 70/3, 6, 50, 51, 54–56, 129, 417, 202, 203, 70/211, 212, DIG. 43, DIG. 56; 292/DIG. 2, 292/DIG. 32, 205, 208, 148, 211, 307 B, 292/281–287, 328–331
See application file for complete search history.

(56) References Cited

U.S. PATENT DOCUMENTS 1,251,591 A * 1/1918 Stoddart ..... 70/299
3,245,240 A * 4/1966 De Forrest ..... 70/209
4,033,156 A * 7/1977 Cottingham ..... 70/56
4,630,456 A * 12/1986 Nielsen, Jr. ..... 70/232
4,718,259 A * 1/1988 Appelbaum ..... 70/63
5,410,896 A * 5/1995 Gleason ..... 70/202
5,590,682 A * 1/1997 Fischer ..... 137/382
5,697,235 A * 12/1997 Briones ..... 70/209
5,762,386 A 6/1998 Fuehrer
5,845,521 A * 12/1998 Najera ..... 70/56
5,927,111 A * 7/1999 Nachbauer ..... 70/161
6,010,166 A * 1/2000 Hamilton et al. ..... 292/282
6,036,240 A * 3/2000 Hamilton et al. ..... 292/202
6,481,765 B1 11/2002 Jelavic
6,578,886 B1 6/2003 Bystry et al.
6,581,419 B1 6/2003 Stodtman
6,928,843 B1 * 8/2005 Pirnie ..... 70/54

* cited by examiner

*Primary Examiner*—Lloyd A. Gall
(74) *Attorney, Agent, or Firm*—Patent & Trademark Services, Inc; Joseph H. McGlynn

(57) ABSTRACT

A protective cover for cargo seals. The cover has two parts with intermating elements on the two parts, and a pair of apertures that can be aligned in the two parts. When the apertures are aligned a padlock hasp can be passed through the aligned apertures.

13 Claims, 1 Drawing Sheet

1
2
3
4
5
7
8

2
3
4
5
6
7
8
9
10
11
12
13

2
4
5
14
15
16
17
18
19

19
20

SEAL GUARD

BACKGROUND OF THE INVENTION

This invention relates, in general, to protective covers, and, in particular, to protective covers for the seals on doors.

DESCRIPTION OF THE PRIOR ART

In the prior art various types of protective covers have been proposed. For example, U.S. Pat. No. 6,581,419 to Strodtman discloses a single piece cover for a hasp and lock with apertures to allow the cover to be placed on the camming handle of a cargo door.

U.S. Pat. No. 6,578,886 to Bystry et al discloses a self locking wire seal with a two part body to cover the seal.

U.S. Pat. No. 6,481,765 to Jelavic discloses a two part security seal with a security wire which passes through two grooves on one part and then through a central opening between the parts.

U.S. Pat. No. 5,762,386 to Fuehrer discloses a tamper resistant seal which has two parts and the wire is embedded in one part and protrudes from an end of the part.

SUMMARY OF THE INVENTION

The present invention is directed to a protective cover for cargo seals. The cover has two parts with intermating elements on the two parts, and a pair of apertures that can be aligned in the two parts. When the apertures are aligned a padlock hasp can be passed through the aligned apertures.

It is an object of the present invention to provide a new and improved protective cover which can be easily placed over a seal.

It is an object of the present invention to provide a new and improved protective cover which will protect the seal from unauthorized removal.

It is an object of the present invention to provide a new and improved protective cover which will be inexpensive to manufacture and easy to use.

These and other objects and advantages of the present invention will be fully apparent from the following description, when taken in connection with the annexed drawings.

DESCRIPTION OF THE PREFERRED EMBODIMENT

Figures 1, 2, 3, 4:
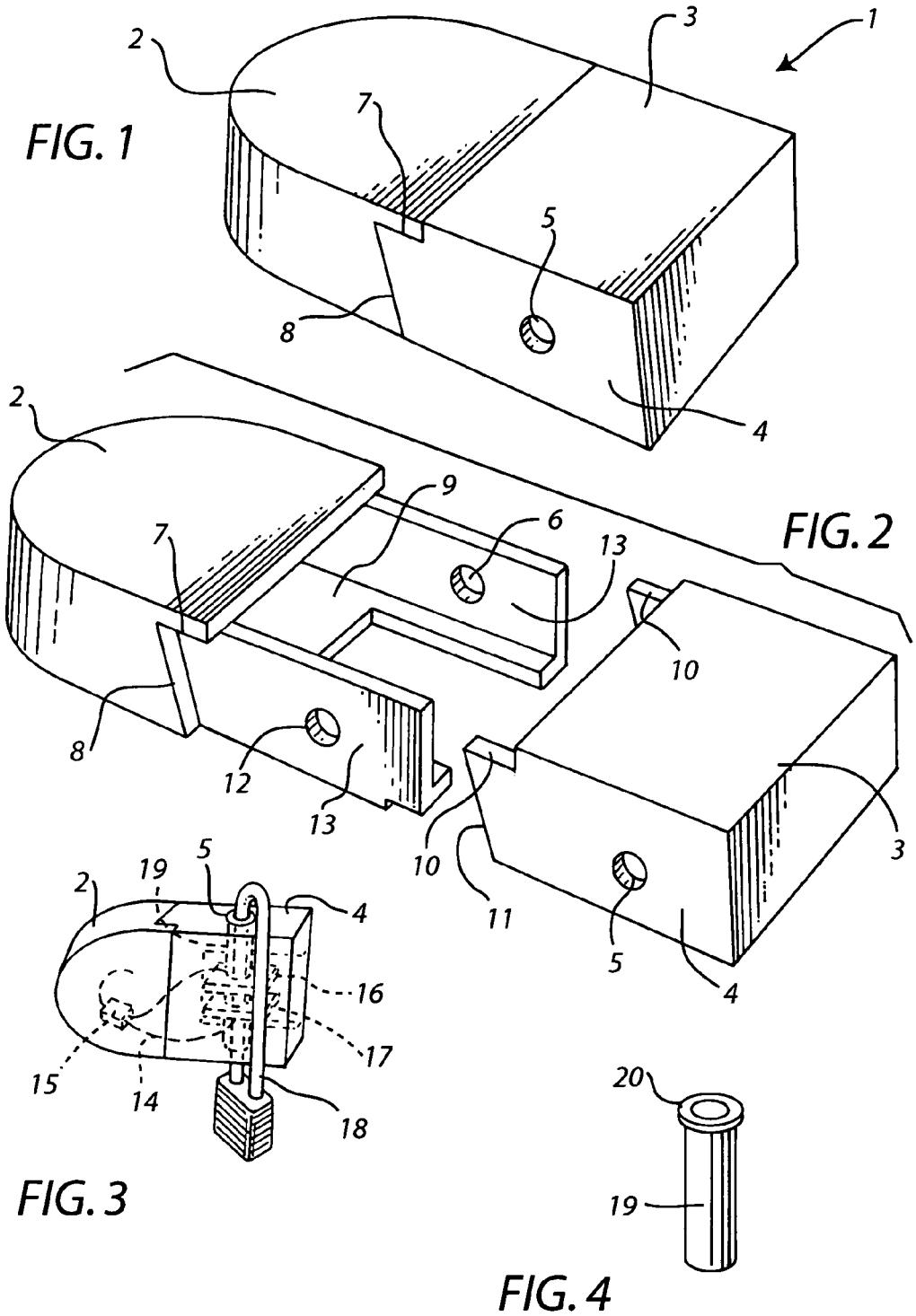
FIG. 1 is a perspective view of the present invention with the two parts closed.
FIG. 2 is a perspective view of the present invention with the two parts open.
FIG. 3 is perspective view of the present invention with the two parts closed around a seal.
FIG. 4 is a perspective view of an alignment device for the present invention.

Referring now to the drawings in greater detail, FIG. 1 shows the protective cover 1 of the present invention. The cover has two parts or halves 2, 3. Each half 2, 3 has a top surface, a bottom surface and sides connecting the top and bottom surfaces. The two mating halves 2, 3 are shown in a joined condition in FIG. 1 and in a separated condition in FIG. 2. As shown in FIGS. 1 and 2 the two mating halves 2, 3 have aligned apertures 12, 6 in sides 13 of part 2, and aligned apertures 5 (only one of which can be seen in FIGS. 1 and 2). Sides 13 and floor 9 of half 2 will be received inside half 3 when the two halves are joined to form a protective cover that extends completely around the seal 14, 15 as shown in FIG. 3.

The sides of part 2 have alignment formations to help align the apertures 5, 6, 12 when the mating halves 2, 3 are mated. The alignment formations comprise a horizontal ledge 7 which is joined to a downwardly sloping wall 8. The downwardly sloping wall 8 extends from the rear end of ledge 7 to the bottom of the half 2, as shown in FIG. 2. The sides 4 of part 3 also have alignment formations to help align the apertures 5, 6, 12 when the mating halves 2, 3 are mated.

The alignment formations on part 3 comprise a horizontal ledge 10 which is joined to a downwardly sloping wall 11. The downwardly sloping wall 11 extends from the forward end of ledge 10 to the bottom of half 3, as shown in FIG. 2. When the halves 2, 3 are joined the ledges 7, 10 will mate and the sloping walls 8, 11 will also mate to form an uninterrupted cover, and the top surface of part 2 will be coplanar with the top surface of part 3. In addition to providing an uninterrupted cover, the mating surfaces 7, 10, 8, 11 will help to align the apertures 5, 6, 12 so the hasp 18 of a padlock can be easily passed therethrough.

It should be noted that while it is preferred that the alignment formations are formed on both sides of parts 2, 3, the alignment surfaces could be formed on only one side of parts 2, 3 without departing from the scope of the invention. Providing the alignment formations 7,8,10, 11 makes it easier for a user to join the two mating halves 2, 3. The alignment tube 19 (see FIG. 4) will be inserted through aligned apertures 6, 12 in sides 13 and through the apertures in the aligned flanges 16, 17. The alignment tube 19 will make it easier for a user to place the present invention on the door. This is especially true if the user is trying to do all this in bad weather or at night. The alignment formations allow the user to join the mating halves almost completely by feel if necessary.

In order to make aligning the apertures 5, 6, 12, as well as the apertures in the flanges 16, 17 and inserting the hasp 18 even easier, a hollow alignment tube 19 is provided, as shown in FIG. 4. The alignment tube 19 is inserted through the mating apertures 6, 12 until the flange 20 engages side 13 of half 2 after half 2 is placed onto flanges 16, 17. After tube 19 is inserted, half 3 is slid into place and hasp 18 can be passed through the tube and the aligned apertures to join the halves permanently.

In order to use the protective cover 1 of the present invention, a user would install the seal on the door in the normal manner. That is, he would close the doors until the flanges 16, 17 (see FIG. 4) are aligned. A wire 14 is passed through apertures in the flanges and a conventional seal 15 is applied to the wire.

Next, part 2 is mounted onto flanges 16, 17 and alignment tube 19 is passed through the aligned apertures until flange 20 rests against the outside surface on side 13. Next, half 3 is mated to half 2. The alignment formations 7, 8, 10, 11 provide a visual indicator of the proper way to hold half 3 as it is mated to half 2, and in poor visibility they provide a tactile indicator of the proper way to hold the halves in order to join them. At this point, a hasp 18 of a padlock can be easily inserted through aligned apertures 5 and tube 19 thus joining halves 2, 3 since tube 19 holds apertures 6, 12 of half 2 and the apertures in flanges 16, 17 in alignment.

Although the Seal Guard and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

The invention claimed is:

1. A protective cover for a seal on a cargo door, said protective cover comprising:

a first part, said first part having a top surface and a bottom surface and sides connecting said top and bottom surfaces, apertures in said sides of said first part, a second part, said second part having a top surface and a bottom surface and sides connecting said top and bottom surfaces, apertures in said sides of said second part, said first part and said second part move from a relative first position to a relative second position, wherein said movement is a linear movement, and means on at least one of said sides of said first part for aligning said first part for engagement with means on said second part during said linear movement, and wherein said means on said first part comprises a horizontal ledge adjacent said top surface of said first part, and a downward sloping wall which starts at said horizontal ledge and extends to said bottom surface of said first part, and a horizontal ledge adjacent said top surface of said second part, and a downward sloping wall which starts at said horizontal ledge and extends to said bottom surface of said second part, and when said first and second parts are joined, said top surface of said first part is coplanar with said top surface of said second part.

2. The protective cover as claimed in claim 1, wherein said means on said first part for aligning said first part for engagement with said second part is positioned on two sides of said first part.

3. The protective cover as claimed in claim 1, wherein said means on said second part for aligning said first part for engagement with said second part is positioned on two sides of said second part.

4. The protective cover as claimed in claim 1, wherein said apertures in said sides of said first part align with said apertures in said sides of said second part when said first and second parts are joined, and means for insertion into said aligned apertures for holding said first and second parts together.

5. The protective cover as claimed in claim 1, wherein a tube is inserted into said apertures on said first part.

6. The protective cover as claimed in claim 5, wherein said tube is hollow.

7. The protective cover as claimed in claim 5, wherein said tube is inserted only into said apertures on said first part.

8. A protective cover for a seal on a cargo door, said protective cover comprising:

a first part, said first part having a top surface and a bottom surface and sides connecting said top and bottom surfaces, apertures in said sides of said first part, a second part, said second part having a top surface and a bottom surface and sides connecting said top and bottom surfaces, apertures in said sides of said second part, means on at least one of said sides of said first part for aligning said first part for engagement with said second part, and wherein said second part has means on at least one of said sides of said second part for cooperating with said means on said first part for aligning said first part for engagement with said second part, and said means on said first part for aligning said first part for engagement with said second part comprises a ledge and a downwardly sloping wall, and said means on said second part for aligning said first part for engagement with said second part comprises a ledge and a downwardly sloping wall, and wherein said first part and said second part move from a relative first position to a relative second position, and wherein said movement is a linear movement, and when said first and second parts are joined, said top surface of said first part is coplanar with said top surface of said second part.

9. The protective cover as claimed in claim 8, wherein said downwardly sloping wall on said first part starts at a back end of said ledge and slopes to said bottom surface of said first part, and wherein said downwardly sloping wall on said second part starts at a front end of said ledge and slopes to said bottom surface of said second part.

10. The protective cover as claimed in claim 8, wherein said apertures in said sides of said first part align with said apertures in said sides of said second part when said first and second parts are joined, and means for insertion into said aligned apertures for holding said first and second parts together.

11. The protective cover as claimed in claim 8, wherein a tube is inserted into said apertures on said first part.

12. The protective cover as claimed in claim 11, wherein said tube is hollow.

13. The protective cover as claimed in claim 11, wherein said tube is inserted only into said apertures on said first part.

* * * * *